United States Patent [19]

Pierce

[11] 4,311,084

[45] Jan. 19, 1982

[54] PNEUMATIC ENGINE

[76] Inventor: Richard V. Pierce, 2605 Hadley St., St. Louis, Mo. 63106

[21] Appl. No.: 109,601

[22] Filed: Jan. 4, 1980

[51] Int. Cl.[3] ..... F01L 33/02; F15B 13/044

[52] U.S. Cl. ..... 91/188; 91/270; 91/448; 91/459

[58] Field of Search ..... 91/188, 270, 16, 448, 91/183

[56] References Cited

U.S. PATENT DOCUMENTS

| | | | |
|---|---|---|---|
| 1,304,864 | 5/1919 | Edwards | 91/270 |
| 3,369,457 | 2/1968 | Guinot | 91/16 |
| 4,104,955 | 8/1978 | Murphy | 91/188 |

*Primary Examiner*—Paul E. Maslousky

*Attorney, Agent, or Firm*—Cohn, Powell & Hind

[57] ABSTRACT

A compressed air engine having a throttle with compressed air being supplied to the throttle. The engine includes at least two cylinders each having a reciprocating piston therein. Air is supplied from the throttle to the cylinders to drive the pistons within the cylinders. A crankshaft is coupled to the pistons and is rotatably driven in response to the reciprocating motion of the pistons. Each cylinder includes an inlet valve for allowing compressed air into the cylinder during a power stroke and preventing compressed air from entering the cylinder during an exhaust stroke, and includes an exhaust valve connecting the cylinder to atmosphere during the exhaust stroke and closing the connection to atmosphere during the power stroke. The inlet and exhaust valves are auger type valves with the inlet auger valves remaining open for approximately 180 degrees of crankshaft rotation and the exhaust auger valves remaining open for approximately the remaining 180 degrees of crankshaft rotation. Operatively connected between the throttle and the cylinders are valves for selectively interrupting the flow of compressed air to at least one of the cylinders while allowing compressed air to at least one other cylinder. The valve, which interrupts the flow of compressed air to the one cylinder, allows the inlet valve of the one cylinder to communicate with atmosphere when the compressed air is disconnected from the one cylinder.

4 Claims, 6 Drawing Figures

PNEUMATIC ENGINE

BACKGROUND OF THE INVENTION

This invention relates generally to a compressed air or pneumatic engine, and particularly to a piston type pneumatic engine in which the flow of compressed air to individual cylinders can be selectively interrupted.

In the known prior art, the speed and work output of the engine is controlled by the throttling of the flow of compressed air to the engine.

Many loads, currently driven by engines, are of the type which require a fairly high torque or work output of the engine to overcome inertia and put the load in motion. However, once the running speed of the load has been reached, the load has momentum requiring only a lesser amount of work to overcome frictional losses to keep the load moving. An example is an automobile which in operation requires more work out of its engine when accelerating to an operating speed than when traveling at the chosen operating speed.

In the known prior art pneumatic engines, compressed air is supplied to each of the cylinders regardless of the operating speed and work required of the engine. When the engine is operating at high speeds, compressed air must be supplied to each of the cylinders even though the required torque or work output of the engine may be low. This represents an inefficiency or waste of energy as air which has been compressed by the expenditure of work is being utilized mainly to fill a void created by the displacement of the pistons as the engine turns. If the engine could be operated at a given higher speed requiring low torque output while utilizing less compressed air, the efficiency of the engine would be improved.

SUMMARY OF THE INVENTION

This compressed air engine provides a means for independently controlling the flow of compressed air to individual cylinders of the engine. Such control can be utilized to provide high torque output, such as when starting a load in motion, by allowing compressed air to flow to all of the cylinders. As the speed of the load is increased and the required torque or work output decreases, individual cylinders may be disconnected from the supply of compressed air to improve engine efficiency by decreasing the amount of compressed air used.

The compressed air engine includes a throttle means with means operatively connected to the throttle means for providing compressed air to the throttle means. The engine includes at least two cylinders each having a reciprocating piston therein, and means operatively connecting the throttle means to the cylinders for providing compressed air from the throttle means to the cylinders to drive the pistons. The engine also includes a crankshaft coupled to the pistons and rotatively driven in response to the reciprocating motion of the pistons. Means are operatively connected between the throttle means and the cylinder for selectively interrupting the flow of compressed air to at least one of the cylinders while allowing compressed air to at least one other cylinder.

In one aspect of the invention, cylinders are mounted radially of the crankshaft.

Each cylinder includes an inlet valve for allowing compressed air into the cylinder during a power stroke of the engine and preventing compressed air from entering a cylinder during an exhaust stroke of the engine. Each of the cylinders also include an exhaust valve connecting the cylinder to low pressure or atmosphere during the exhaust stroke and closing the connection to low pressure or atmosphere during the power stroke.

The selective interrupting means comprise valves which selectively disconnect the flow of compressed air to the one cylinder while allowing the inlet valve of the same cylinder to communicate with atmosphere when the compressed air is disconnected, thereby preventing the piston from drawing against a vacuum during the power stroke of that piston.

In one aspect of the invention, the inlet valves and the exhaust valves are auger valves. In another aspect of the invention, the inlet auger valves remain open for approximately 180° of crankshaft rotation, that is from approximately top dead center to bottom dead center of the piston travel, and the exhaust auger valves remain open for approximately the remaining 180° of the crankshaft rotation.

In the preferred embodiment, the compressed air engine includes four cylinders with compressed air being supplied to all four cylinders when the engine is being started or running at less than a first predetermined speed and a high work output is required. The flow of compressed air to two of the cylinders is interrupted when the engine speed is at the first predetermined speed, and the flow of the compressed air to a third of the cylinders is interrupted when the engine speed is greater than a second predetermined speed greater than the first predetermined speed and little work output of the engine is required.

DESCRIPTION OF THE PREFERRED EMBODIMENT

Figure 2:
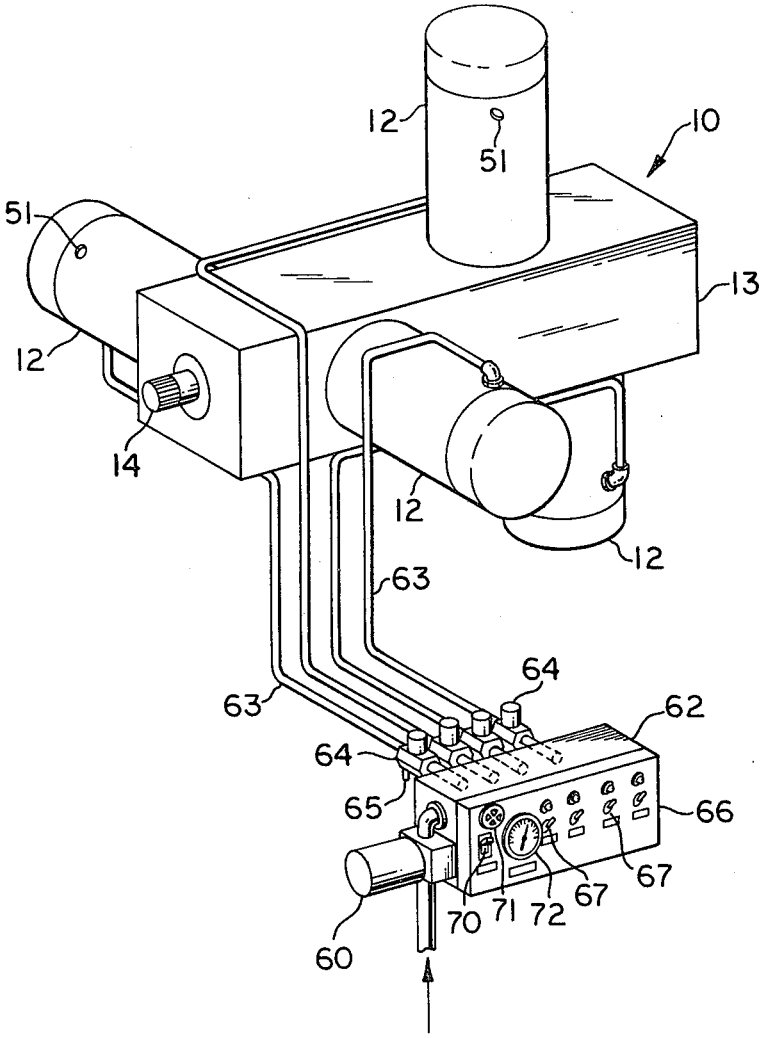
FIG. 2 is a perspective view of the engine.
Figure 3:
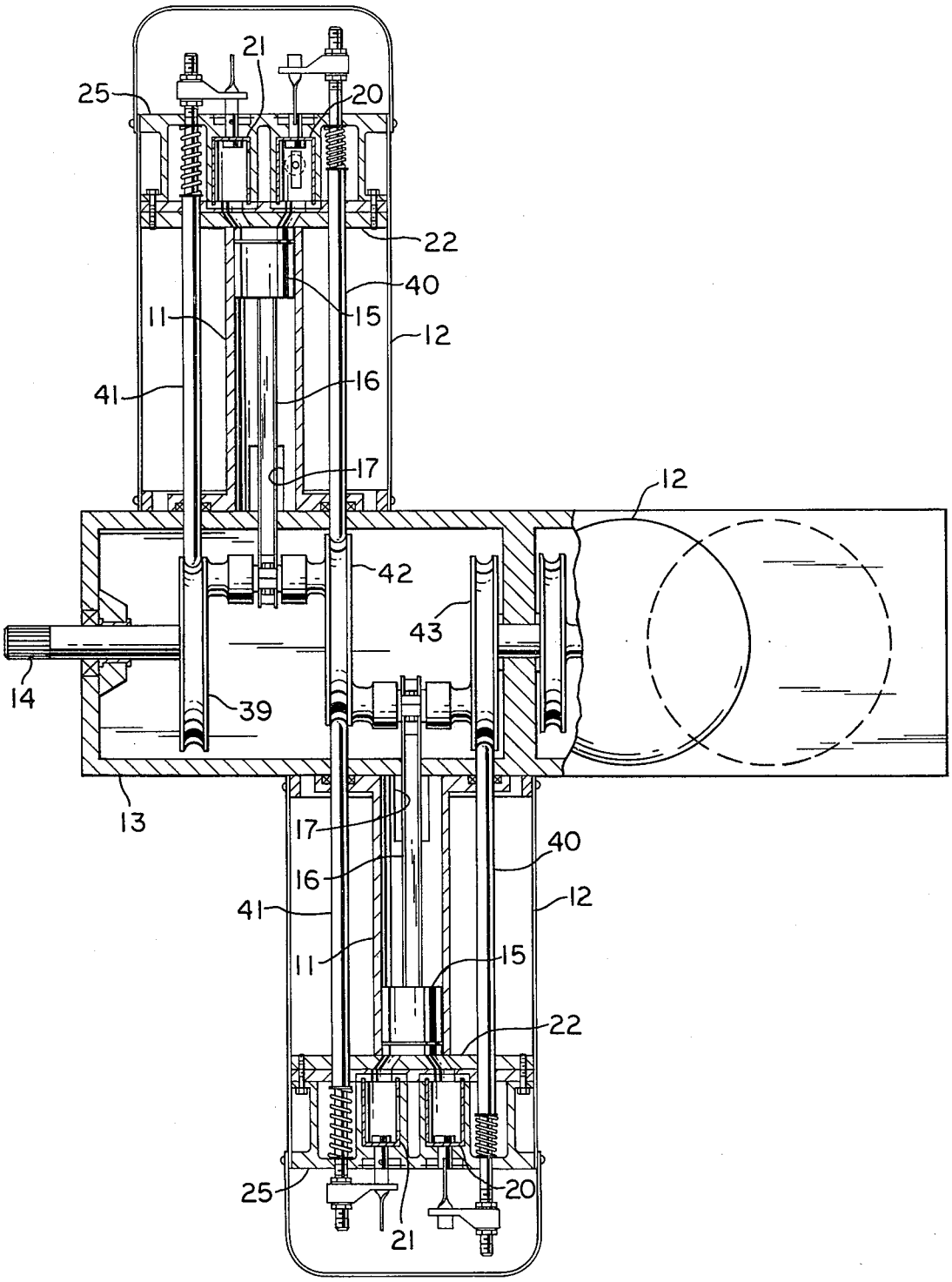
FIG. 3 is a partial sectional view of the engine.

Referring now by characters of reference to the drawings and first to FIGS. 2 and 3, it will be understood that the compressed air engine generally indicated by 10 includes four radially mounted cylinders 11 within cylinder covers 12. The cylinders 11 and cylinder covers 12 each are attached at one end to a crankcase 13. Journal-mounted within the crankcase 13 is a crankshaft 14.

Each cylinder 11 includes a piston 15 which is attached to the crankshaft 14 by a piston arm 16 in a conventional manner. The cylinders 11 include slots 17 adjacent to and communicating with the crankcase 13 for allowing lateral travel of the piston arm 16.

Figure 4:
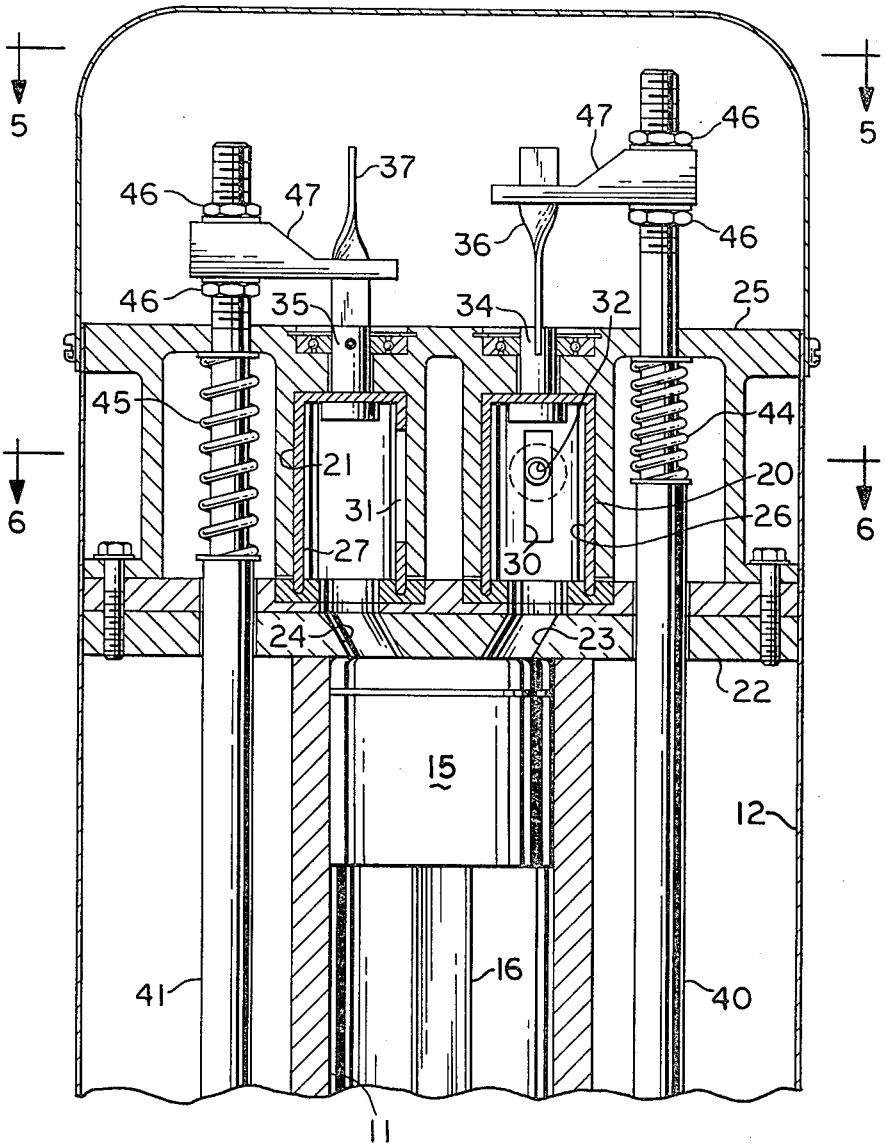
FIG. 4 is an enlarged sectional view of the inlet and exhaust valves.
Figure 5:
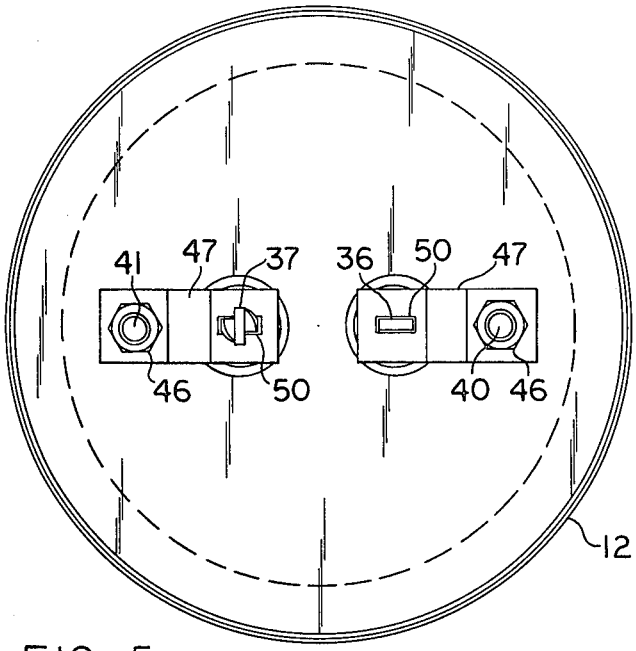
FIG. 5 is a sectional view taken on line 5—5 of FIG. 4.
Figure 6:
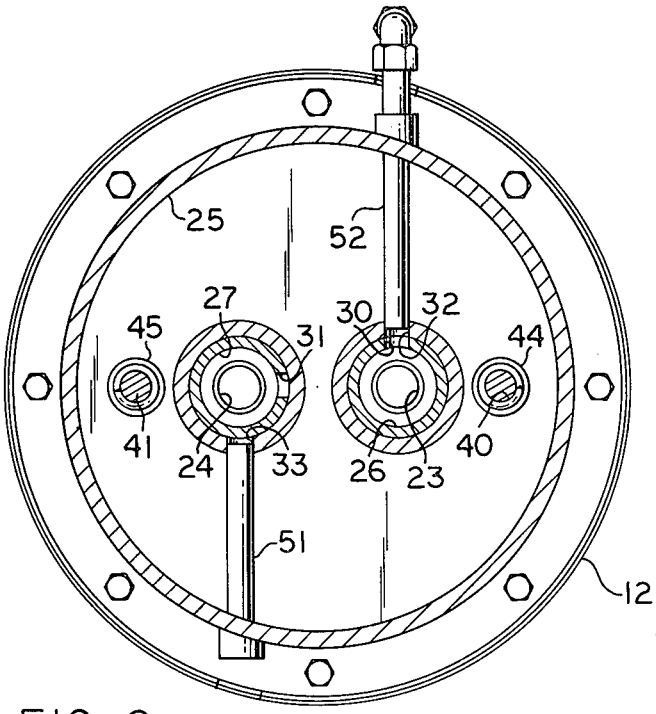
FIG. 6 is a sectional view taken on line 6—6 of FIG. 4.

Referring now to FIGS. 4, 5 and 6, it can be seen that each cylinder 11 includes an inlet valve 20 and an exhaust valve 21. In the preferred embodiment, the inlet and exhaust valves 20 and 21 constitute auger valves. It will be apparent to those skilled in the art that a single valve could function as both an inlet and exhaust valve.

However, in the preferred embodiment, separate inlet and exhaust valves are utilized.

Each cylinder head 22 includes inlet and exhaust passages 23 and 24 respectively communicating with the cylinder 11. A valve bracket 25 is attached to the cylinder head 22. Cup-shaped valve parts 26 and 27 each having a side slot 30 and 31 form part of the inlet and exhaust valves 20 and 21 respectively, and are located within the valve bracket 25. The valve bracket 25 includes an inlet port 32 and an exhaust port 33. Attached to the cup-shaped valve parts 26 and 27 are stems 34 and 35 which are attached to twisted vanes 36 and 37 extending through the top of the valve bracket 25. The vanes 36 and 37, stems 34 and 35 and attached cups 26 and 27 are rotatable within the valve bracket 25 from open positions in which the slots 30 and 31 communicate with the ports 32 and 33 respectively, to positions in which there is no communication between the cup slots 30 and 31 and the ports 32 and 33. Inlet valve rods 40 and exhaust valve rods 41 are engageable with cams 39, 42 and 43 on the crankshaft 14. In the embodiment of FIG. 3, the cam 42 serves to accomodate the inlet valve 20 of one cylinder 11 and the exhaust valve 21 of another cylinder 11. Springs 44 and 45 bias the rods 40 and 41 against the cams 42 and 43. Attached to each rod 40 and 41 as by bolts 46 are radially projecting guides 47, the guides 47 each including a guide slot 50 for receiving a vane 36 or 37. The rising and falling of the rods 40 and 41 following the cams 42 and 43 cause the vanes 36 and 37 to turn, thereby opening and closing the valves 20 and 21. As seen in FIG. 6, an exhaust passage 51 passing through the cylinder cover 12 permits the exhaust port 33 to communicate with low pressure which in the preferred embodiment is atmosphere. An inlet passage 52 is provided between the cylinder cover 12 and the inlet port 32 for providing compressed air to the inlet valve 20.

Figure 1:
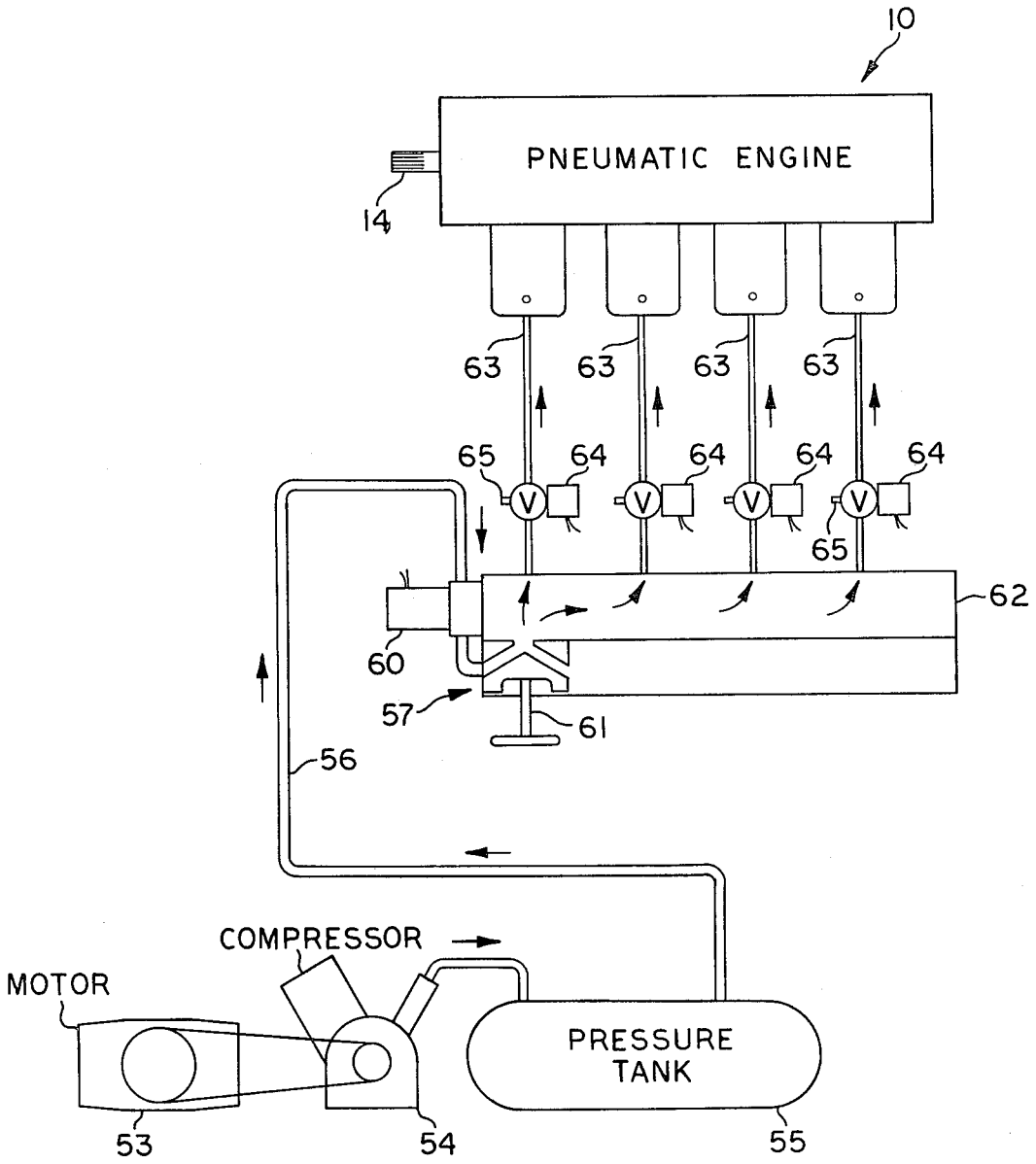
FIG. 1 is a schematic view of the compressed air engine and source of compressed air.

A typical compressed air supply system is disclosed in the schematic view of FIG. 1. A motor 53 which can be electric, internal combustion or other type drives a compressor 54 for supplying air to a pressure tank 55, the operation of such air supply systems being well known in the art.

A throttle supply line 56 constitutes means operatively connected to a throttle means 57 for providing compressed air to the throttle means 57, the throttle supply line 56 being connected to the pressure tank 55. In the preferred embodiment, the throttle means 57 includes a solenoid-operated shut-off valve 60, and a throttle valve 61. It is understood that the throttle valve 61 could operate as a shut-off valve in place of the solenoid valve 60.

Means operatively connect the throttle means 57 to the cylinders 11 for providing compressed air from the throttle means 57 to the cylinders 11 to drive the pistons 15. The throttle valve 61 provides means for regulating or throttling the flow of compressed air to the cylinders 11.

In the preferred embodiment, compressed air is supplied from the throttle valve 61 to a manifold 62. A plurality of cylinder supply lines 63 connect the manifold 62 to the cylinders 11 through the inlet passages 52 in the inlet valves 20. Interrupting valves 64, connected to the cylinder lines 63, are operatively connected between the throttle means 57 and the cylinders 11 for selectively interrupting the flow of compressed air to at least one of the cylinders 11. In the preferred embodiment, the interrupting valves 64 are solenoid-operated two-way valves. The interrupting valves 64 selectively disconnecting the flow of compressed air to one of the cylinders 11 while allowing the inlet valve 20 of that cylinder 11 to communicate with atmosphere when the supply of compressed air is disconnected from the cylinder 11. The interrupting valves 64, including atmosphere ports 65, which communicate with the inlet valves 20 when the interrupting valves 64 are actuated to interrupt the flow of compressed air to a cylinder 11.

Referring now to FIG. 2, a control panel 66 is shown attached to the manifold 62. It will of course be understood that the control panel can be located remotely of the manifold 62. The control panel 66 includes a plurality of switches 67 for selectively actuating the interrupting valves 64. The panel 66 also includes a shut-off switch 70 for actuating the solenoid valve 60 for shutting off the supply of compressed air. In the preferred embodiment, the shut-off switch 70 also actuates the interrupting valves 64 so as to connect the inlet valves 20 of each of the cylinders 11 to atmosphere, thereby allowing the engine 10 to "free wheel" when the shut-off switch 70 is actuated. A knob 71 on the control panel 66 is used to operate the throttle valve 61. It is understood that other mechanically or electrically operated throttle valves could be substituted for the throttle valve 61 of the preferred embodiment. The panel 66 also includes a pressure gauge 72 for monitoring the pressure of the compressed air supply.

It is thought that the structural features and functional advantages of applicant's compressed air engine have become fully apparent from the foregoing description of parts, but for completeness of disclosure, the operation of the device will be briefly discussed.

The engine 10 is basically a two-stroke engine, the two strokes being the power stroke which occurs when compressed air is being supplied to a cylinder 11, and the exhaust or return stroke which occurs during the time compressed air is not supplied to the cylinder 11. The inlet valves 20 are open for the power stroke, that is approximately 180 degrees of crankshaft rotation, which occurs from the top dead center position of the piston 15 to the bottom dead center position of the piston 15. During the exhaust stroke, which is the other approximately 180 degrees of crankshaft rotation, the exhaust valve 21 is open and the piston 15 returns from bottom dead center to a top dead center position. The cams 42 and 43 of the crankshaft 14 are appropriately shaped to give the desired opening and closing times of the inlet and exhaust valves 20 and 21.

In the preferred embodiment, four radially mounted cylinders 11 are included. Two opposed side cylinders 11 have simultaneous power and exhaust strokes. The remaining two cylinders 11 are 90 degrees displaced from the first said two cylinders 11 and 180 degrees displaced from each other. The crankshaft 14 is arranged so that during the power stroke of the first two cylinders 11, the second two cylinders 11 are in their exhaust stroke, and vice versa.

When it is desired to operate the engine 10, the solenoid valve 60 is actuated to supply compressed air to the throttle valve 61 for supplying air through the manifold 62 and cylinder supply line 63 to the cylinders 11. It is of course understood that the crankshaft 14 is connected to some load (not shown). During the start-up, when it is necessary to accelerate the load, maximum work output from the engine 10 may be required. The interrupting valves 64 are all actuated to permit the flow of compressed air to each of the cylinders 11. As the load gains momentum, a lesser work output from the engine 10 is required, and two of the interrupting valves 64 can be actuated to interrupt the flow of compressed air to the two corresponding cylinders 11. The inlet valves 20 of these cylinders 11 are connected to atmosphere through the valves 64 so as not to represent a drag on the engine 10 which would occur if the pistons 15 of the cylinders 11 were drawing against a vacuum.

When the load has been accelerated to a greater speed and momentum and little work output is required of the engine 10, the interrupting valve 64 of a third cylinder line 63 can be actuated to interrupt the flow of compressed air to a third cylinder 11. At this point, the engine 10 is operating on only one cylinder 11, thereby conserving the use of compressed air where a low work output is required of the engine 10.

I claim as my invention:

1. A compressed air engine comprising:

(a) a throttle means, (b) means operatively connected to the throttle means for providing compressed air to the throttle means, (c) at least two cylinders each having a reciprocating piston therein, (d) means operatively connecting the throttle means to the cylinders for providing compressed air from the throttle means to the cylinders to drive the pistons, (e) a crankshaft coupled to said pistons, and rotatively driven in response to the reciprocating motion of said pistons, (f) means operatively connected between the throttle means and cylinders for selectively interrupting the flow of compressed air to at least one of the cylinders while allowing compressed air to at least one other cylinder, (g) each cylinder including an inlet valve for allowing compressed air into the cylinder during a power stroke and preventing compressed air from entering the cylinder during an exhaust stroke, (h) each of the cylinders including an exhaust valve connecting the cylinder to atmosphere during the exhaust stroke and closing the connection to low pressure during the power stroke, and (i) the selective interrupting means comprising two-way valves which selectively disconnecting the flow of compressed air to the said one cylinder while allowing the inlet valve of the same cylinder to communicate with atmosphere when the compressed air is disconnected.

2. A compressed air engine as defined in claim 1, in which:

(j) the inlet valves and exhaust valves are auger valves.

3. A compressed air engine as defined in claim 2, in which:

(k) the inlet auger valves remain open for approximately 180° of crankshaft rotation, and (l) the exhaust auger valves remain open for approximately the remaining 180° of the crankshaft rotation.

4. A compressed air engine comprising:

(a) a throttle means, (b) means operatively connected to the throttle means for providing compressed air to the throttle means, (c) four cylinders, each having a reciprocating piston therein, (d) means operatively connecting the throttle means to the cylinders for providing compressed air from the throttle means to the cylinders to drive the pistons, (e) a crankshaft coupled to said pistons and rotatively driven in response to the reciprocating motion of said pistons, (f) means operatively connected between the throttle means and cylinders for allowing the flow of compressed air to all four cylinders when the engine is being started or running at less than a first predetermined speed, and for interrupting the flow of compressed air to two preselected cylinders when the engine speed is at the first predetermined speed, and for interrupting the flow of compressed air to a third preselected cylinder when the engine speed is greater than a second predetermined speed greater than the first predetermined speed, (g) each cylinder including an inlet valve for allowing compressed air into the cylinder during a power stroke and preventing compressed air into the cylinder during an exhaust stroke, (h) each of the cylinders including an exhaust valve connecting the cylinder to atmosphere during the exhaust stroke and closing the connection to atmosphere during the power stroke, (i) the selective interrupting means comprising two-way valves which selectively disconnecting the flow of compressed air to the said preselected cylinders while allowing the inlet valves of the same preselected cylinders to communicate with atmosphere when the compressed air is disconnected, and (j) the inlet valves and exhaust valves being auger valves.

* * * * *